United States Patent [19]

Pesola et al.

[11] 4,098,483

[45] Jul. 4, 1978

[54] SWIVEL PLANT HANGER

[76] Inventors: Jeannette E. Pesola; Oiva J. Pesola, both of 29 Normal Rd., Fitchburg, Mass. 01420

[21] Appl. No.: 736,509

[22] Filed: Oct. 28, 1976

[51] Int. Cl.[2] ..... A47G 29/00

[52] U.S. Cl. ..... 248/311.1 R; 248/304; 248/222.2

[58] Field of Search ..... 248/311, 222.2, 222.3, 248/223.1, 223.2, 223.3, 223.4, 224, 225, 339, 340, 341, 215

[56] References Cited

U.S. PATENT DOCUMENTS

| | | | |
|---|---|---|---|
| 2,506,119 | 5/1950 | Tregear | 248/304 |
| 2,990,642 | 7/1961 | Bloom et al. | 248/311.1 |
| 3,199,820 | 8/1965 | Thompson | 248/304 |
| 3,341,163 | 9/1967 | Honig | 248/311 |
| 3,995,822 | 12/1976 | Einhorn et al. | 248/304 |

FOREIGN PATENT DOCUMENTS

| | | | |
|---|---|---|---|
| 1,357,505 | 6/1974 | United Kingdom | 248/222.2 |

*Primary Examiner*—Robert A. Hafer
*Attorney, Agent, or Firm*—Charles R. Fay

[57] ABSTRACT

A plant hanger comprising an elongated member bent down at both ends, a swivel depending from one end, and the opposite end being held in a bracket removably mounted on a plate on a molding or casing, e.g. above a window. The bracket is also attachable by itself to the face of the molding or casing.

1 Claim, 6 Drawing Figures

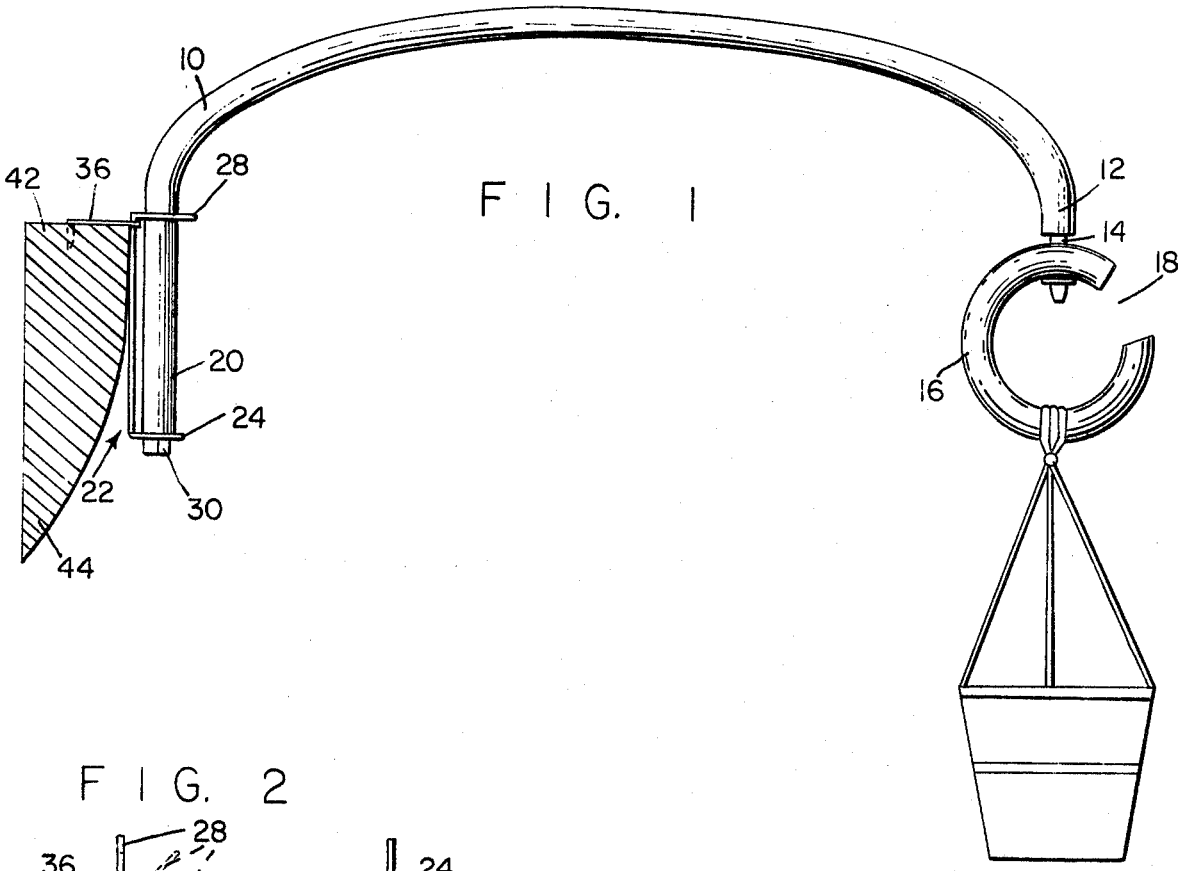
FIG. 1
FIG. 2
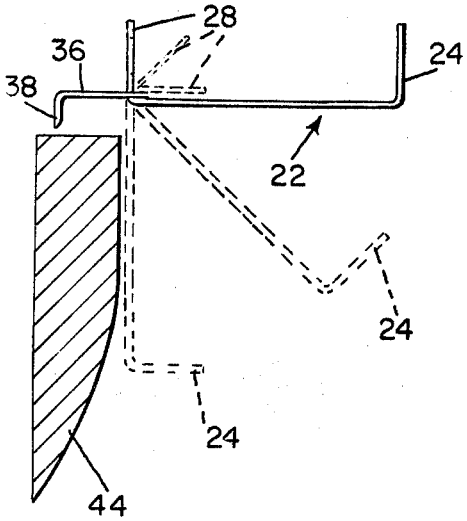
FIG. 3
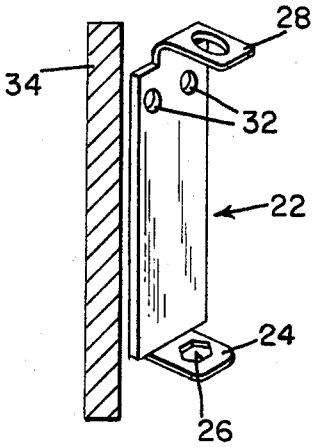

SWIVEL PLANT HANGER

BACKGROUND OF THE INVENTION

There have been many plant hangers suggested but the object of the present invention is to provide an extremely simple one which is easily mounted and which can be mounted on a removable bracket detachably connected with respect to a plate which is installed with a single nail on top of casings or moldings so that a plant can be hung substantially anywhere in most rooms in a dwelling.

SUMMARY OF THE INVENTION

A rod or the like is bent down at both ends and a swivel is mounted at one end for hanging a plant thereon at any angle desired. The opposite end of the rod, etc., is adapted to be held generally vertical and is firmly but detachably held by two spaced ears on a bracket which is detachably connected to a plate mounted in out-of-the-way substantially invisible position at the top edge of the casing or molding found in most rooms.

If it should be desired to mount the hanger in another location where the top edge of a molding or casing is not available, the bracket itself is provided with nail holes so that it can be fastened in position wherever desired, and in this case it is still detachable but only by removal of nails or other fastenings such as screws.

BRIEF DESCRIPTION OF THE FIGURES

FIG. 1 is a view in side elevation;

FIG. 2 is a view illustrating the application of the bracket to the plate with respect to a molding or casing;

FIG. 3 illustrates the bracket as applied to a blank wall;

PREFERRED EMBODIMENT OF THE INVENTION

Figure 4:
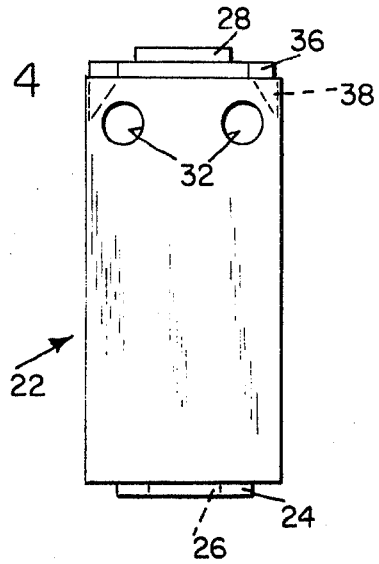
FIG. 4 is a front view of the bracket as attached to the plate.

In FIG. 1 there is shown a curved rod, tube, or the like 10 having a slightly downturned free end 12 with a rivet 14 in the end thereof swivelly mounting a ring 16 having an opening 18 by which the plant 20 may be inserted by a hook, tie, or the like.

The opposite end of the rod 20 is turned down to a substantially vertical position.

Figure 5:
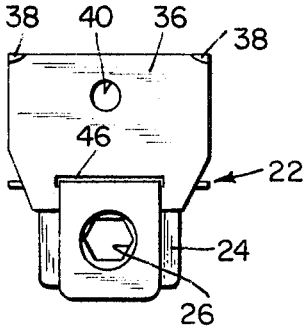
FIG. 5 is a top plan view of FIG. 4.
Figure 6:
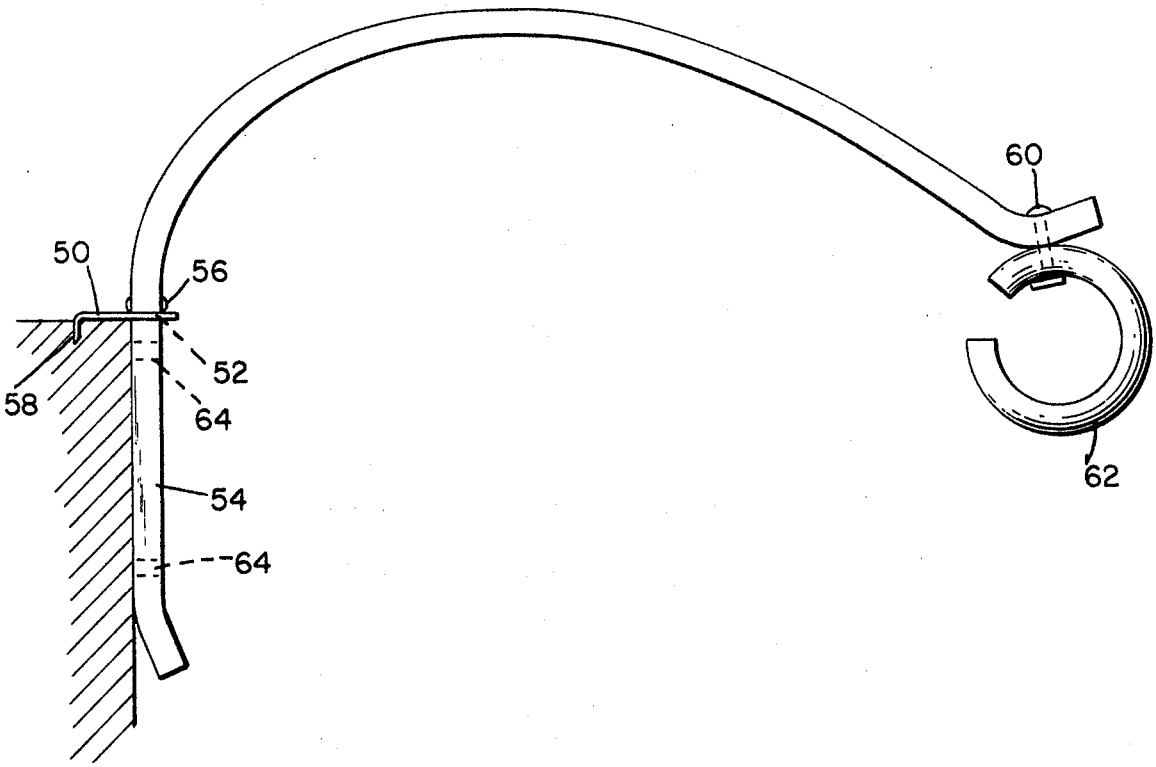
FIG. 6 illustrates a modification.

A bracket generally indicated at 22 has a bottom ear 24 with a hex opening in it at 26, see FIG. 5, and there is a top ear 28 with an opening therein in which the downturned end 20 of the rod 10 is received.

The extreme lower end of the downturned end of the rod as at 30 is pressed into a hex shape to fit the hole 26 and maintain the rod in different angular positions on its vertical axis, also tending to support the rod in position on the bracket.

The bracket may have nail or screw holes 32 if it is desired to mount the same directly on a wall 34 as in FIG. 3.

However, it is preferred that a flat plate 36 with downturned spikes 38,38 and a nail hole 40, be applied to a top edge at 42 of a molding or casing 44 such as is normally found over windows and around ceilings, etc. This plate is provided with a slot at its forward edge, the slot being indicated at 46. The slot is a little wider than the top ear 28 of bracket 22, so that as shown in FIG. 2, with the plate in position, the top ear 28 of the bracket 22 may be slipped upwardly through slot 46, thus extending outwardly from the casing or molding 44 to support the rod in the position shown in FIG. 1.

A modification of the device resides in the provision of a flat plate 50 having a rectangular hole in it at 52 for the reception of a square or rectangular sectioned rod 54 with a protrusion 56 to prevent it from sliding any farther down through plate 50. Plate 50 has spikes 58 for attachment to the casing as above described together with a nail if desired and at its extreme outer end it is provided with a rivet 60 swivelly mounting a partial ring 62. The downturned portion of the rod at 54 may be provided with nail holes 64,64 if desired for securing the rod directly to a wall, but in this case of course the hanger is not detachable except by removing the fasteners which extend through holes 64.

It is wished to be emphasized that no nails or other fasteners are used with respect to bracket 22 or rod 54 unless it is not desired to use plates 36 or 50.

I claim:

1. A plant hanger comprising a flat co-planar plate, means to fasten the plate to a horizontal surface of a support with a portion of the plate extending out from the surface, a slot in the extending portion of the plate, said support having a vertical surface intersecting the horizontal surface, said slot having an edge substantially coinciding with the intersection of the two surfaces, an elongated member having a downturned end portion that extends through the slot and directly impinges on the vertical surface of the support, along a major portion of the downturned portion of the elongated member, the elongated member having a major portion extending out from the support, and a partial ring swivelly mounted on the member at its end opposite the said end portion.

* * * * *